US006279498B1

(12) United States Patent
Hattori et al.

(10) Patent No.: US 6,279,498 B1
(45) Date of Patent: Aug. 28, 2001

(54) HEADGEAR FRAME APPARATUS

(75) Inventors: Osamu Hattori; Masahiko Ozeki, both of Ichinomiya (JP)

(73) Assignee: Kabushiki Kaisha Barudan, Ichinomiya (JP)

( * ) Notice: Subject to any disclaimer, the term of this patent is extended or adjusted under 35 U.S.C. 154(b) by 0 days.

(21) Appl. No.: 09/537,222

(22) Filed: Mar. 29, 2000

(30) Foreign Application Priority Data

Mar. 30, 1999 (JP) ..... 11-127519
Apr. 14, 1999 (JP) ..... 11-106170

(51) Int. Cl.[7] ..... D05C 9/04

(52) U.S. Cl. ..... 112/103

(58) Field of Search ..... 112/103, 63, 309, 112/318, 322, 102.5, 470.06, 470.14, 470.17, 475.11

(56) References Cited

U.S. PATENT DOCUMENTS 5,261,338 * 11/1993 Tajima et al. ..... 112/103
6,065,413 * 5/2000 Kawaguchi ..... 112/470.14

* cited by examiner

*Primary Examiner*—Peter Nerbun
(74) *Attorney, Agent, or Firm*—Pillsbury Winthrop LLP

(57) ABSTRACT

A headgear frame apparatus comprises: a headgear frame for clamping a headgear; and a rotary drive frame for fitting the headgear frame replaceably thereon on the side of a sewing machine. The headgear frame is provided at its outer circumference with a brim which is further projected outward. On the outer circumference of the rotary drive frame, there are tiltably hinged levers which have hook pawls projected toward the rotary drive frame and which are biased by springs in the direction where the hook pawls approach the rotary drive frame. When the headgear frame is fitted on the rotary drive frame, the brim once raises the hook pawls in the direction away from the rotary drive frame, and after the hook pawls rode over the brim, the hook pawls are hooked on the brim by the biasing forces of the springs.

7 Claims, 6 Drawing Sheets

HEADGEAR FRAME APPARATUS

BACKGROUND OF THE INVENTION

1. Field of the Invention

The present invention relates to a headgear frame apparatus of a sewing machine for embroidering a headgear.

2. Description of the Related Art

As shown in FIG. 6, a conventional headgear frame apparatus 105 is provided with a cylindrical rotary drive frame 106 for turning a headgear 1 in front of a sewing machine frame in the circumferential direction of the circumferential portion 5 of the headgear 1, and a headgear frame 100 detachably attached to the rotary drive frame 106.

On the outer circumference of the rotary drive frame 106, there are disposed three holding rollers 107 which are equidistantly spaced in the circumferential direction for fixing the headgear frame 100. These holding rollers 107 are biased by (not-shown) springs to hold the outer circumference of the rotary drive frame 106.

A receiving frame 101 of the headgear frame 100 is provided with three engaging holes 108 corresponding to the individual holding rollers 107. When this headgear frame 100 is to be attached to the rotary drive frame 106, its receiving frame 101 is fitted and forced on the rotary drive frame 106. Then, the individual holding rollers 107 come into engagement with the engaging holes 108 so that the headgear frame 100 is fixed. When the headgear frame 100 is detached, on the other hand, it is forcibly pulled from the rotary drive frame 106. Then, the individual holding rollers 107 are disengaged from the engaging holes 108.

Here, in order to fixing the headgear frame 100 on the rotary drive frame 106 without any chatter, it is necessary to intensify the pushing forces of the holding rollers 107. Then, the headgear frame 100 has to be pushed or pulled by accordingly strong forces for bringing the holding rollers 107 into or out of engagement with the engaging holes 108 when the headgear frame 100 is to be attached or detached. This makes these attaching and detaching works difficult for the powerless worker.

When the headgear frame 100 is to be removed, on the other hand, the strong pulling force is required till the holding rollers 107 and the engaging holes 108 come out of engagement. After this disengagement, however, the receiving frame 101 of the headgear frame 100 is just fitted on the rotary drive frame 106 so that the headgear frame 100 can be easily removed by a weak force. If the headgear frame 100 is pulled extensively strongly, therefore, the holding rollers 107 and the engaging holes 108 are disengaged, but simultaneously with this, the headgear frame 100 may entirely come out from the rotary drive frame 106. This makes it difficult to moderate the force for pulling the headgear frame 100.

In order to ensure the attachment of the headgear frame 100, moreover, the engagement between the holding rollers 107 and the engaging holes 108 has to be visually confirmed, and this confirmation is troublesome.

Thus, it is not efficient to attach and detach the headgear frame 100 to and from the rotary drive frame 106 which is disposed on the sewing machine side.

SUMMARY OF THE INVENTION

An object of the invention is to provide a headgear frame apparatus which facilitates attachment and detachment of a headgear frame to and from a rotary drive frame.

In the invention, therefore, there are taken the following means, as will be individually described with reference to FIGS. 1 to 5.

According to an aspect of the invention, there is provided a headgear frame apparatus 9 comprising: a headgear frame 10 for clamping a headgear 1; and a rotary drive frame 30 for fitting said headgear frame 10 replaceably thereon on the side of a sewing machine (e.g., an embroidering machine), characterized:

- in that the headgear frame 10 is provided at its outer circumference with a brim 23 which is further projected outward;
- in that on the outer circumference of the rotary drive frame 30, there are tiltably hinged at axes 33 levers 32 which have hook pawls 31 projected toward the rotary drive frame 30 and which are biased by springs 34 in the direction where the hook pawls 31 approach the rotary drive frame 30; and
- in that when the headgear frame 10 is fitted on the rotary drive frame 30, the brim 23 once raises the hook pawls 31 in the direction away from the rotary drive frame 30, and thereafter the hook pawls 31 ride over the brim 23, the hook pawls 31 being hooked on the brim 23 by the biasing forces of the springs 34.

In the shown embodiment, the aforementioned members 23, 31, 32, 33 and 34 are provided transversely symmetrically at the headgear frame 10 and the rotary drive frame 30.

The headgear 1 includes a cap, a hat, a beret and any others which can be embroidered and worn on the head.

As in the shown embodiment, it is preferable that the rotary drive frame 30 is provided with abutting projections 35 which come, just before the levers 32 abut against the brim 23 when the hook pawls 31 are hooked on the brim 23, into abutment against said levers 32 to generate abutting sounds and to stop said levers 32.

As in the shown embodiment, it is preferable that the rotary drive frame 30 is provided with spring plungers 36 for pushing the brim 23 in the direction to release the headgear frame 10 from the rotary drive frame 30 when the levers 32 are tilted to unhook the hook pawls 31 from the brim 23.

As in the shown embodiment, it is preferable that the spring plungers 36 push the brim 23 so that the headgear frame 10 may stop when the hook pawls 31 ride over the outer periphery 23*a* of the brim 23.

In this headgear frame apparatus 9, the headgear frame 10 is attached to the rotary drive frame 30 in the following manner:

- The headgear frame 10 with the headgear 1 is fitted on (the outer circumference) of the rotary drive frame 30 disposed on the sewing machine side;
- As the headgear frame 10 is inserted deeply, the brim 23 once raises the hook pawls 31 in the direction away from the rotary drive frame 30. After the hook pawls 31 ride over the brim 23, the hook pawls 31 are hooked on the brim 23 by the biasing forces of the springs 34; and
- Just before the levers 32 abut against the brim 23 when the hook pawls 31 are hooked on the brim 23, the abutting projections 35 abut against the levers 32 to generate the abutting sounds (such as clicks), and the hooking can be confirmed.

On the other hand, the headgear frame 10 is removed from the rotary drive frame 30 in the following manner:

- While holding the headgear frame 10 between the two hands, the levers 32 are tilted by pushing the action ends 32*a* of the left and-right levers 32 with the hand fingers;
- When the hook pawls 31 at the leading ends of the levers 32 are unhooked from the brim 23, the spring plungers 36 push the brim 23 in the direction to release the headgear frame 10 from the rotary drive frame 30 of the headgear frame 10, and then they stop the headgear frame 10 when the hook pawls 31 ride over the outer periphery 23*a* of the brim 23; and At this stage, the levers 32 need not be continuously pushed any more but can be easily removed from the rotary drive frame 30 merely by pulling the headgear frame 10 lightly.

The following effects can be achieved according to this headgear frame apparatus 9:

The headgear frame 10 can be attached or detached by the single action;

The hook pawls 31 are hooked on the brim 23 which is further projected outward from the outer circumference of the headgear frame 10 so that the leading ends of the hook pawls 31 do not probably pierce through the inner circumference of the headgear frame 10;

The brim 23 to be hooked by the hook pawls 31 can be made so sufficiently thick that it can be prevented from being miss-hooked due to wear; and Further objects of this invention will become evident upon an understanding of the illustrative embodiments described below. Various advantages not specifically referred to herein but within the scope of the instant invention will occur to one skilled in the art upon practice of the presently disclosed invention. The following examples and embodiments are illustrative and not seen to limit the scope of the invention.

DETAILED DESCRIPTION OF THE PREFERRED EMBODIMENTS

Figure 1:
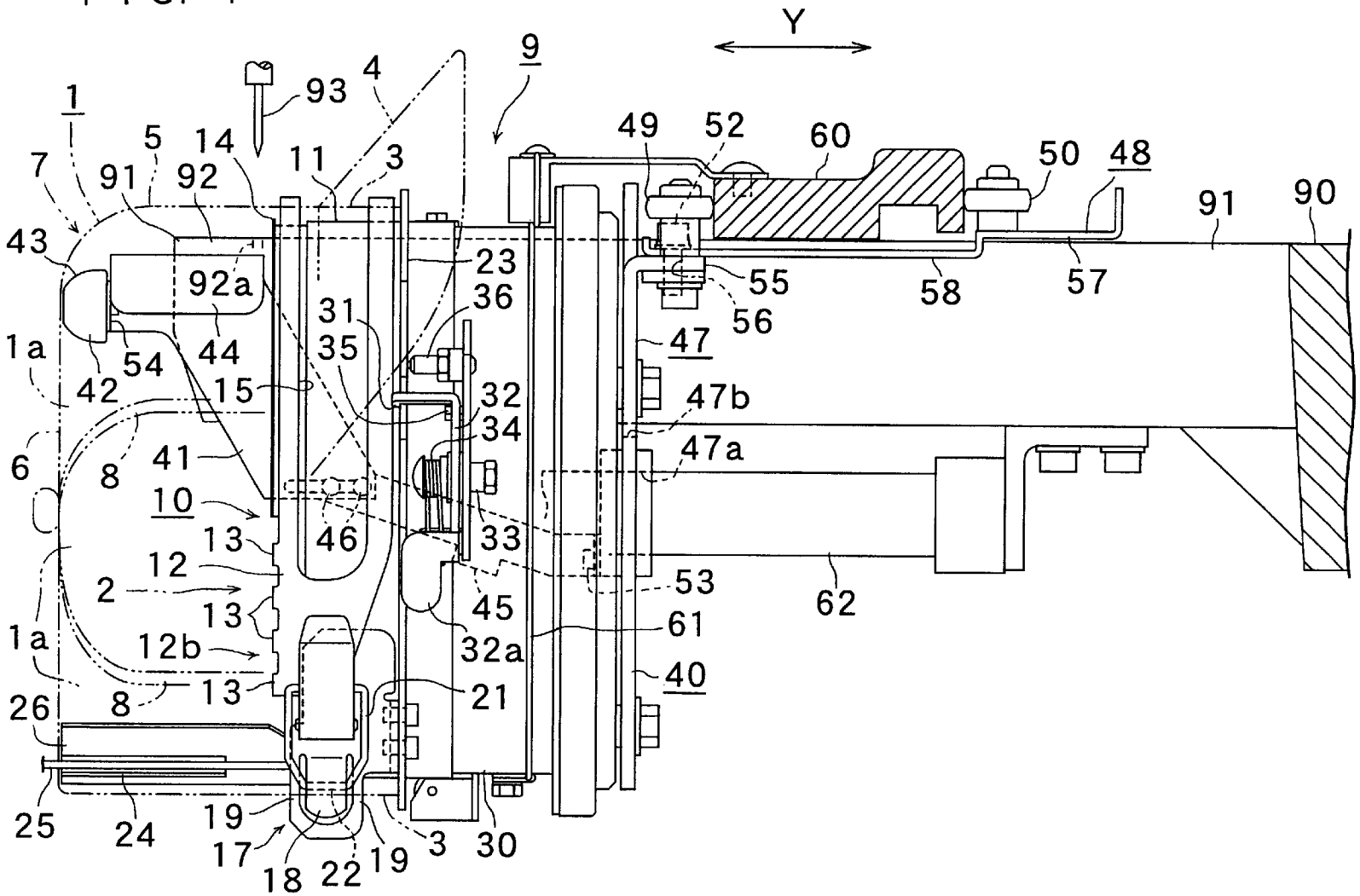
FIG. 1 is a righthand side view showing a headgear frame apparatus for a sewing machine according to an embodiment of the invention.

FIGS. 1 to 5B show a headgear frame apparatus 9 for a sewing machine according to an embodiment of the invention. As shown in FIG. 1, this sewing machine is provided with a cylindrical bed 91 which is projected in parallel with a direction, as indicated by arrow Y, from a machine frame 90. Below and in parallel with the root end side of the cylindrical bed 91, there is projected a guide rail 62 which supports a headgear frame apparatus 9 including the headgear frame 10 in a manner to move in the direction Y. Over the cylindrical bed 91, there is further provided a horizontal drive frame 60 which extends in a horizontal plane in the (not-shown) direction X intersecting the direction Y at a right angle, so that the headgear frame apparatus 9 is moved by the horizontal drive frame 60.

On the upper face of the leading end side of the cylindrical bed 91, there is arranged a throat plate 92 which is provided with a needle eye 92*a* and below which there is packaged a (not-shown) hook wound with a bobbin thread. Over the cylindrical bed 91, there is provided a needle 93 which is made vertically movable in the (not-shown) machine head. And, a headgear (cap) 1, as held on the headgear frame apparatus 9, is embroidered by the association between the needle 93 to be driven on the basis of embroidering data and the aforementioned hook.

The headgear frame apparatus 9 is provided for supporting the embroidering range of the headgear 1 in a proper position just over the cylindrical bed 91. The headgear frame apparatus 9 is constructed to include: a support frame 40 made slidable in the direction Y along the guide rail 62; a rotary drive frame 30 so supported on the support frame 40 as to rotate on an axis parallel to the direction Y; the headgear frame 10 clamping the headgear 1 and replaceably engaged to outside of the rotary drive frame 30; elastic plates 41 mounted on a stay 45, as projected forward from the support frame 40, and extended sideways (to the left and right sides in the shown embodiment) of the cylindrical bed 91; and auxiliary rollers 42 provided rotatably at the leading ends of the elastic plates 41 and rotating in abutment against boundary corner portion 7 between a circumferential portion 5 and a crest portion 6 of the headgear 1 clamped by the headgear frame 10.

Figure 2:
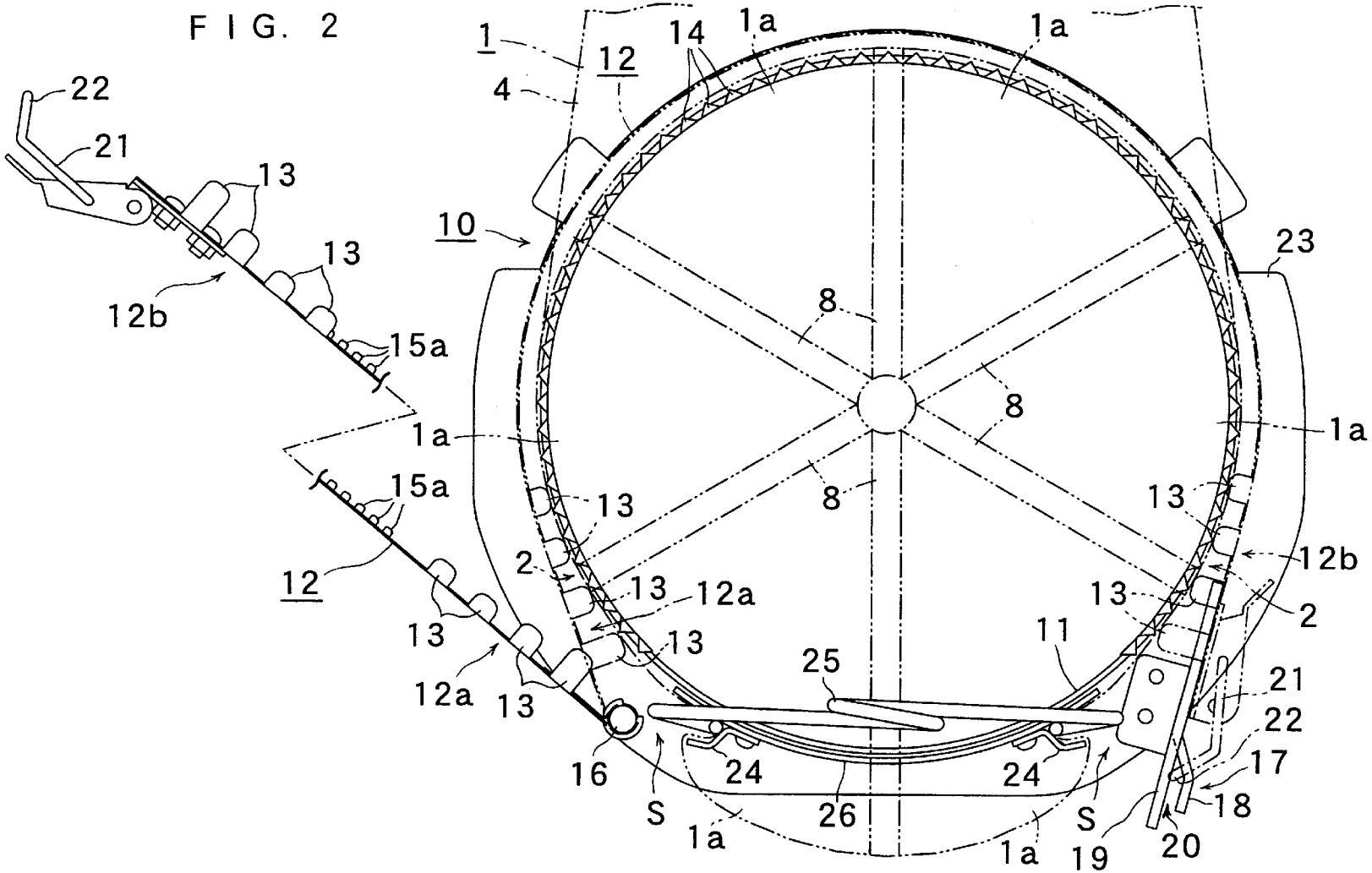
FIG. 2 is a front view of a headgear frame of the same headgear frame apparatus.
Figure 3:
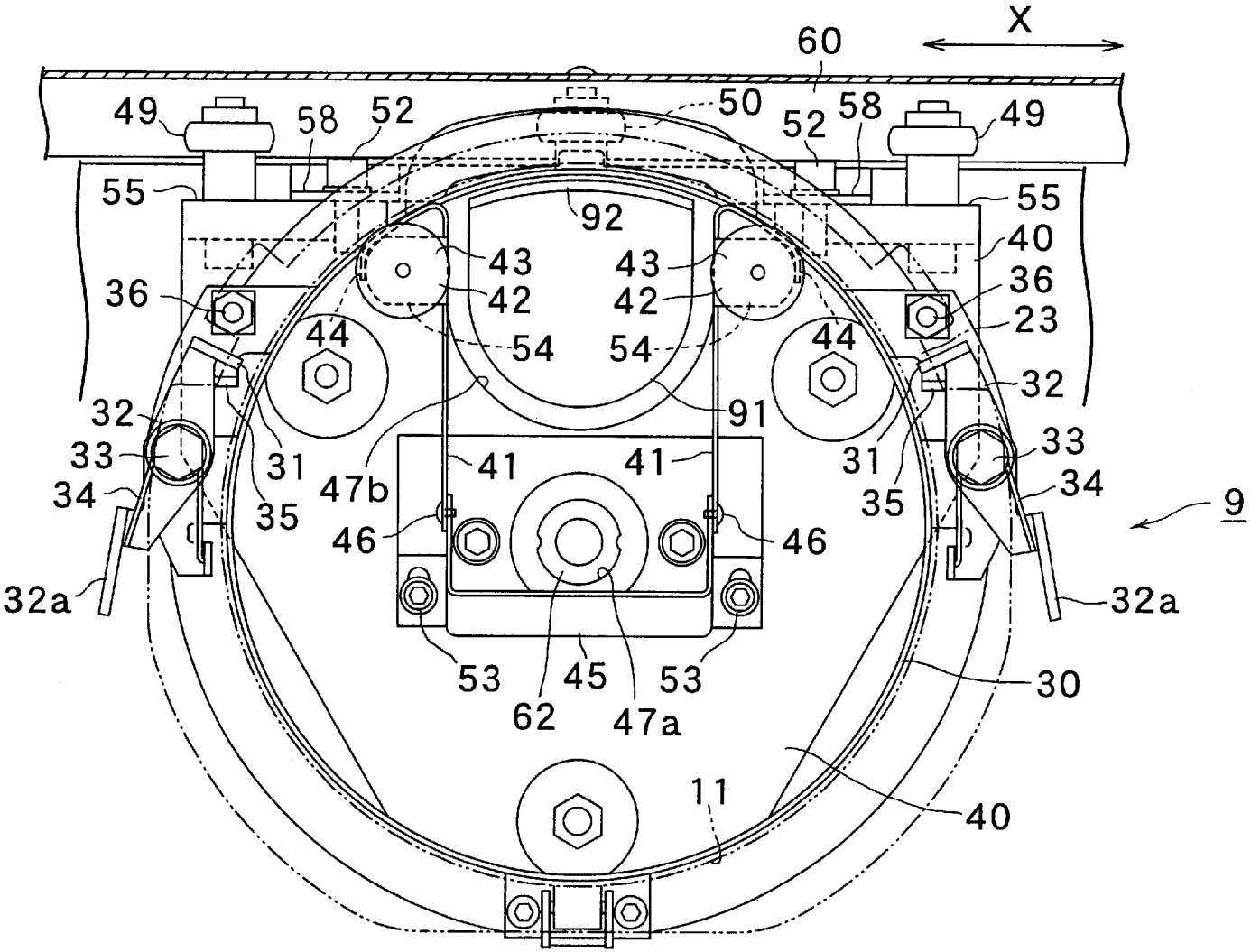
FIG. 3 is a front view of the same headgear frame apparatus.

This headgear frame 10 is provided, as shown in FIGS. 1 to 3, with a cylindrical receiving frame 11 to be inserted into the headgear 1, and a holding band 12 adapted to be wound on the outer side of the headgear 1 to clamp the headgear 1 between itself and the receiving frame 11. The receiving frame 11 of the headgear frame 10 is provided at its outer circumference with a brim 23 which is further projected outward.

On the outer circumference of the rotary drive frame 30, there are tiltably hinged at axes 33 levers 32 which have hook pawls 31 projected toward the rotary drive frame 30. Springs 34 bias said levers 32 in the direction where the hook pawls 31 approach the rotary drive frame 30. When the headgear frame 10 is fitted on the rotary drive frame 30, moreover, the brim 23 once raises the hook pawls 31 in the direction away from the rotary drive frame 30 so that the hook pawls 31 ride over the brim 23. After this, the hook pawls 31 are hooked by the brim 23 by the biasing forces of the springs 34. In the shown embodiment, the aforementioned individual members 23, 31, 32, 33 and 34 are provided transversely symmetrically at the headgear frame 10 and the rotary drive frame 30.

As shown in FIGS. 1, 3, 5A and 5B, the rotary drive frame 30 is provided with abutting projections 35 which come, Just before the levers 32 abut against the brim 23 when the hook pawls 31 are hooked on the brim 23, into abutment against said levers 32 to generate the abutting sounds and to stop said levers 32.

Figure 4:
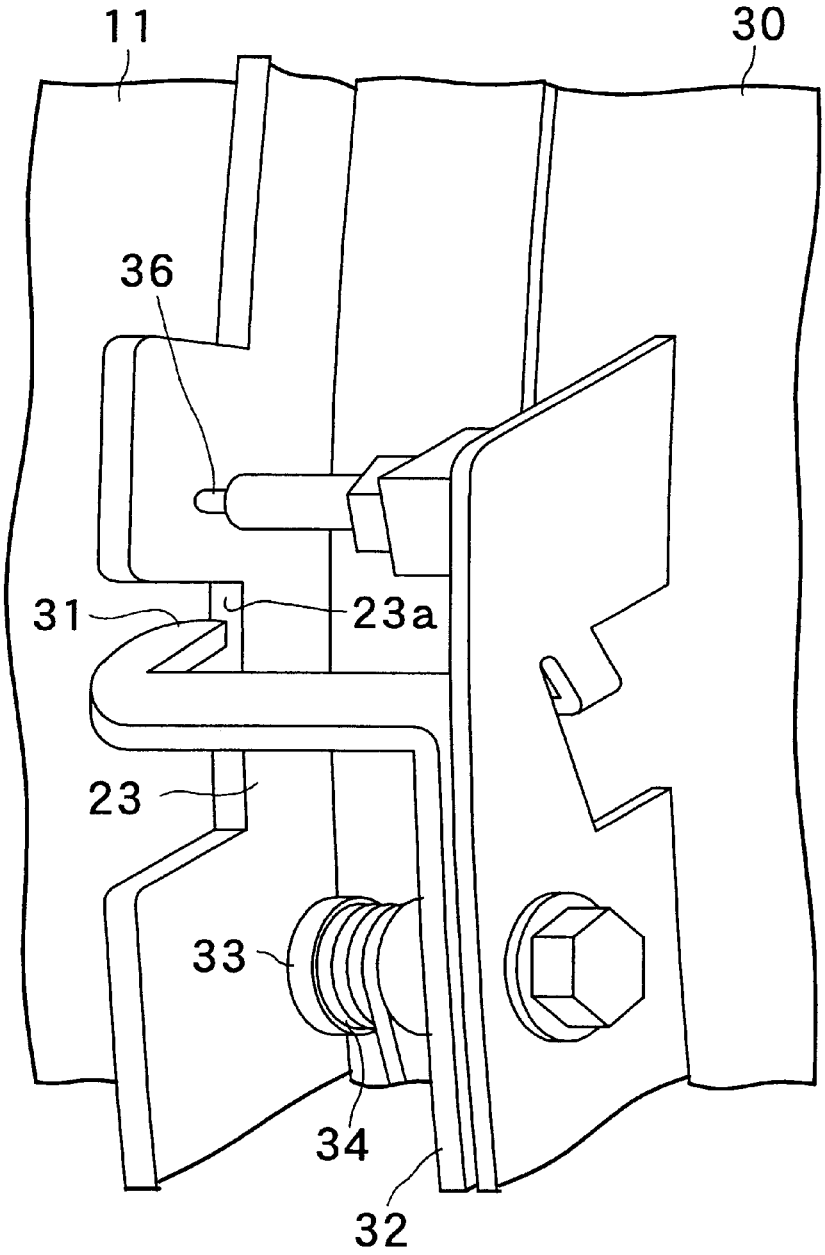
FIG. 4 is a perspective view of the hooked portions of the headgear frame and a rotary drive frame on the same headgear frame apparatus.
Figure 5A:
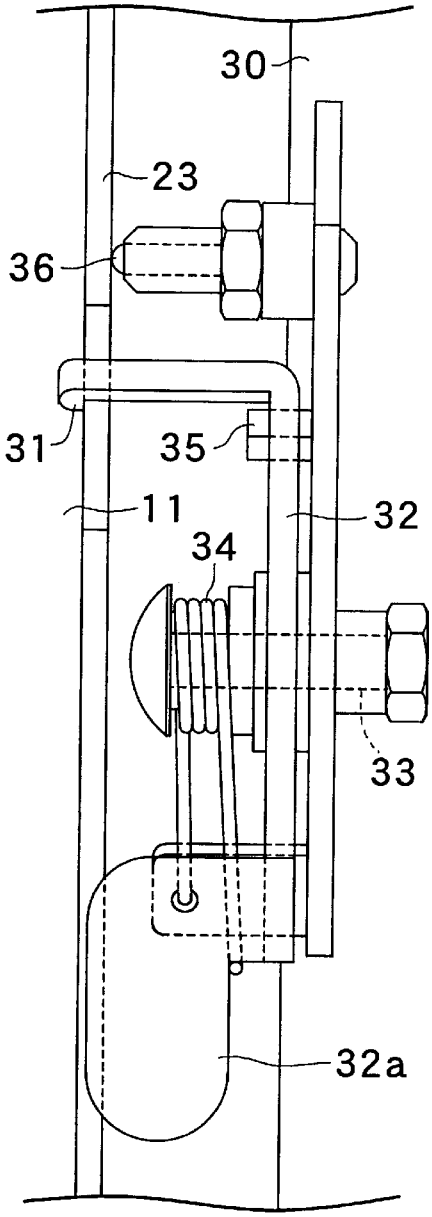
FIGS. 5A and 5B are side views of the same hooked portions.
Figure 5B:
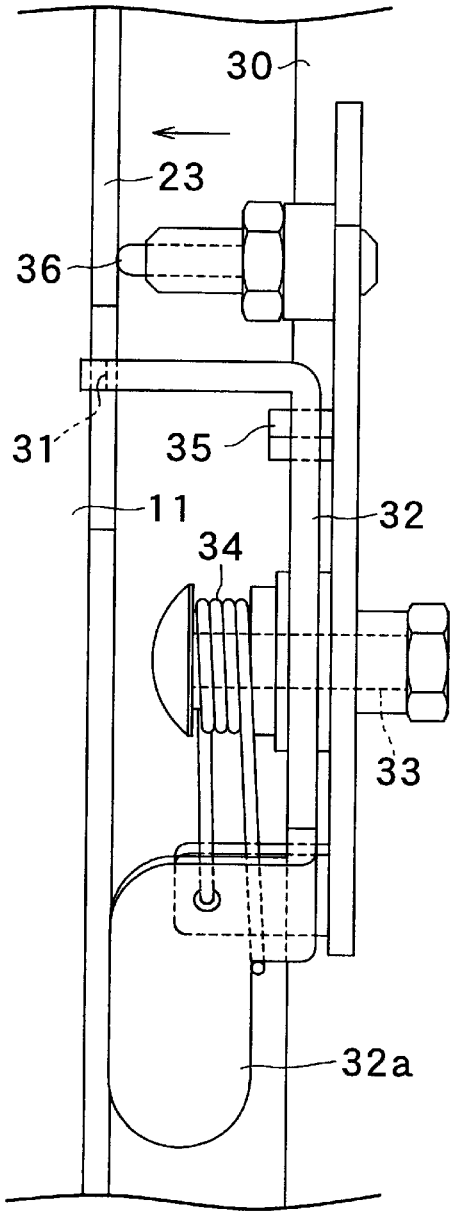
Figure 6:
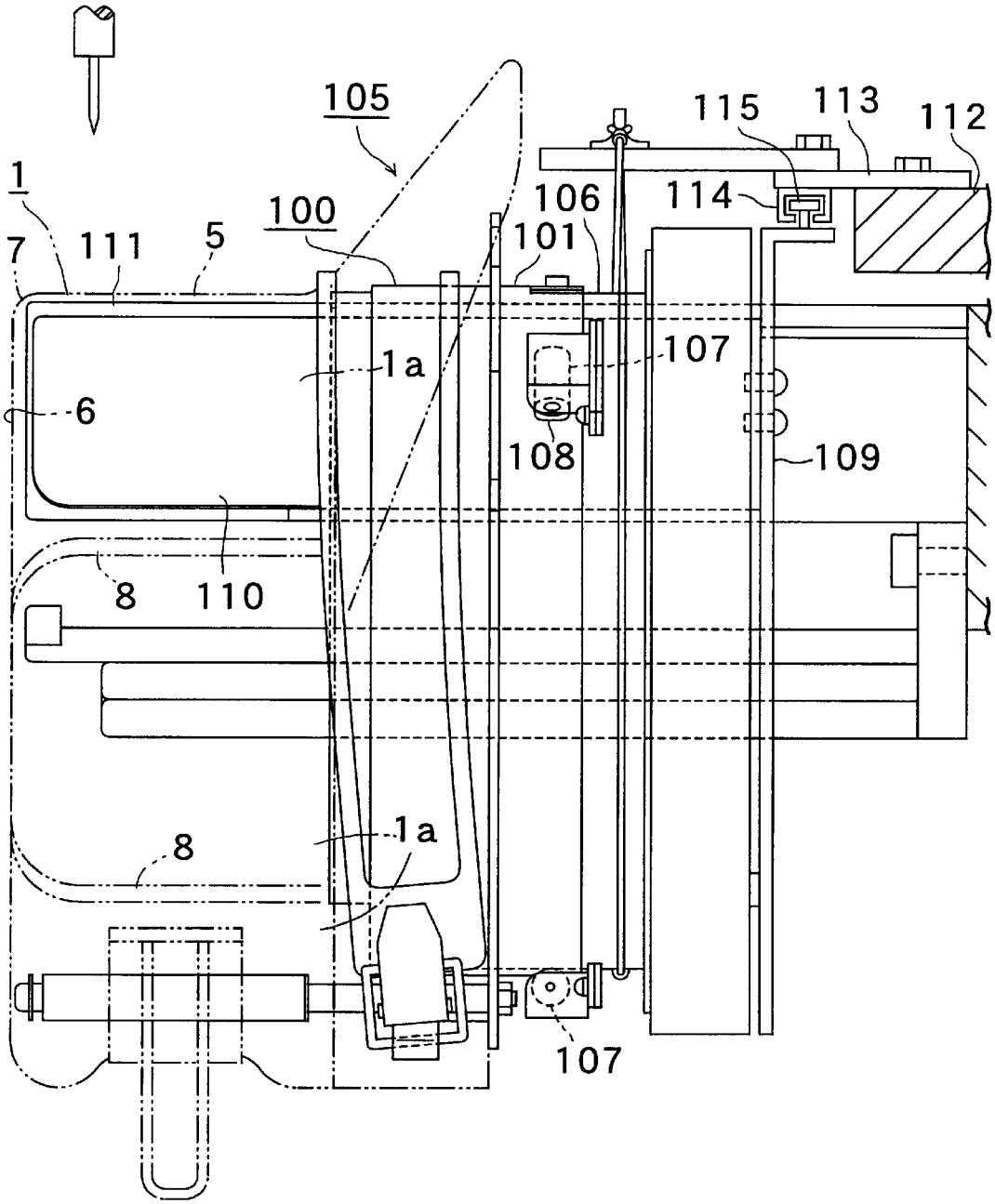
FIG. 6 PRIOR ART
FIG. 6 is a righthand side view showing a conventional headgear frame apparatus of a sewing machine.

As shown in FIGS. 1, 3, 4, 5A and 5B, the rotary drive frame 30 is provided with spring plungers 36 which push the brim 23 in the direction to release the headgear frame 10 from the rotary drive frame 30 (as shown in FIG. 5B) when the levers 32 are pushed and tilted at their action ends 32*a* to unhook the hook pawls 31 from the brim 23 (FIG. 5A shows the hook pawl 31 in its hooked state).

As shown in FIGS. 4 and 5B, the spring plungers 36 push the brim 23 so that the headgear frame 10 may stop when the hook pawls 31 ride over the outer periphery 23*a* of the brim 23.

In the aforementioned construction, it is conceivable to provide the receiving frame 11 with engaging holes in place of the brim 23 so that the hook pawls 31 may be hooked in said engaging holes. Then, the leading ends of the hook pawls 31 may pierce through the inner circumference of the headgear frame 10. In order to prevent these insertions, on the other hand, it is also conceivable to shorten the leading ends of the hook pawls 31, for example. Then, there arises a problem that the aforementioned engaging holes may fail to hook due to the wear at their circumferential edges.

In this headgear frame apparatus 9, the headgear frame 10 is attached to the rotary drive frame 30 in the following manner:

(1) The headgear frame 10 with the headgear 1 is fitted on (the outer circumference of) the rotary drive frame 30 disposed on the side of the sewing machine;

(2) As the head gear frame 10 is inserted deeply, the brim 23 once raises the hook pawls 31 in the direction away from the rotary drive frame 30 (as shown in FIGS. 4 and 5B). After the hook pawls 31 ride over the brim 23, the hook pawls 31 are hooked on the brim 23 (as shown in FIG. 5A) by the biasing forces of the springs 34; and (3) Just before the levers 32 abut against the brim 23 when the hook pawls 31 are hooked on the brim 23, the abutting projections 35 abut against the levers 32 to generate the abutting sounds (such as clicks), and the hooking can be confirmed.

On the other hand, the headgear frame 10 is removed from the rotary drive frame 30 in the following manner:

(1) While holding the headgear frame 10 between the two hands, the levers 32 are tilted by pushing the action ends 32*a* of the left and right levers 32 with the hand fingers;

(2) When the hook pawls 31 at the leading ends of the levers 32 are unhooked from the brim 23, the spring plungers 36 push the brim 23 in the direction to release the headgear frame 10 from the rotary drive frame 30, and then they stop the headgear frame 10 when the hook pawls 31 ride over the outer periphery 23*a* of the brim 23 (as shown in FIGS. 4 and 5B); and (3) At this stage, the levers 32 need not be continuously pushed any more but can be easily removed from the rotary drive frame 30 merely by pulling the headgear frame 10 lightly.

The following effects can be achieved according to this headgear frame apparatus 9:

(a) The construction is made such that the headgear frame 10 is fixed on the rotary drive frame 30 by hooking the hook pawls 31 of the levers 32 on the brim 23. With this construction, therefore, the forces of the springs 34 for biasing the hook pawls 31 may be such that the hooking of the brim 23 by the hook pawls 31 may not be released during the stitching operation. Different from the prior art, therefore, it is possible even for a powerless worker to attach and detach the headgear frame 10 easily to and from the rotary drive frame 30 by the single action;

(b) Since there are provided the spring plungers 36 for pushing the brim 23 in the direction to release the headgear frame 10 from the rotary drive frame 30, the headgear frame 10 is moved, when it is to be removed, through the brim 23 to the position where the hook pawls 31 are not hooked on the brim 23, merely by pushing the action ends 32*a* of the left and right levers 32 to disengage the hook pawls 31 at the leading ends of the levers 32 from the brim 23. This relieves the worker from the simultaneous operations to push the action ends 32*a* of the levers 32 and to move the headgear frame 10 so far to the position at which the hook pawls 31 are not hooked on the brim 23, so that the headgear frame 10 can be easily removed by the single action;

(c) The spring plungers 36 push the brim 23 so that the headgear frame 10 may stop when the hook pawls 31 ride over the outer periphery 23*a* of the brim 23. Even if the hook pawls 31 at the leading ends of the levers 32 are unhooked from the brim 23 by pushing the action ends 32*a* of the left and right levers 32 when the headgear frame 10 is to be removed, the headgear frame 10 remains held on the rotary drive frame 30 by the hook pawls 31 riding on the outer peripheries 23*a* of the brim 23. As a result, the headgear frame 10 neither comes out of nor leaves the rotary drive frame 30. In this state, moreover, the headgear frame 10 can be easily removed from the rotary drive frame 30 merely by pulling it lightly;

(d) The hook pawls 31 are hooked on the brim 23 which is further projected outward from the outer circumference of the headgear frame 10 so that the leading ends of the hook pawls 31 do not probably pierce through the-inner circumference of the headgear frame 10;

(e) The brim 23 to be hooked by the hook pawls 31 can be made so sufficiently thick that it can be prevented from being miss-hooked due to the wear; and (f) Just before the levers 32 abut against the brim 23 when the hook pawls 31 are hooked on the brim 23, the abutting projections 35 abut against the levers 32 to generate the abutting sounds. The fixing (or locking) between the rotary drive frame 30 and the headgear frame 10 can be ensured by confirming those sounds. This eliminates the chatter, as might be caused due to the mistaken attachment, between the rotary drive frame 30 and the headgear frame 10 thereby to provide a decorative embroidering finish.

Here, the present invention should not be limited to the aforementioned construction of the embodiment but could be embodied by making suitable modifications within the gist thereof such that the brim 23, the hook pawls 31, the levers 32, the hinges 33 and the springs 34 are provided at one portion or at three or more portions of the headgear frame 10 and the rotary drive frame 30.

As many apparently widely different embodiments of this invention may be made without departing from the spirit and scope thereof, it is to be understood that the invention is not limited to the specific embodiments thereof except as defined in the appended claims.

What is claimed is:

1. A headgear frame apparatus, comprising:

a head gear frame for clamping a headgear; and a rotary drive frame for fitting said headgear frame replaceably thereon on the side of a sewing machine, wherein said headgear frame is provided at its outer circumference with a brim which is further projected outward;

on the outer circumference of said rotary drive frame, there are tiltably hinged levers which have hook pawls projected toward said rotary drive frame and which are biased by springs in the direction where the hook pawls approach the rotary drive frame; and when the headgear frame is fitted on said rotary drive frame the brim once raises the hook pawls in the direction away from the rotary drive frame, and thereafter the hook pawls ride over the brim, the hook pawls being hooked on the brim by the biasing forces of said springs such that leading ends of the hook pawls do not pierce the inner circumference of the headgear frame.

2. A headgear frame apparatus according to claim 1, wherein the rotary drive frame is provided abutting projections which come, just before said levers abut against the brim when said hook pawls are hooked on the brim, into abutment against said levers to generate abutting sounds and to stop said levers.

3. A headgear frame apparatus according to claim 1, wherein the rotary drive frame is provided with spring plungers for pushing said brim in the direction to release said headgear frame from the rotary drive frame when said levers are tilted to unhook said hook pawls from the brim.

4. A headgear frame apparatus according to claim 2, wherein the rotary drive frame is provided with spring plungers for pushing said brim in the direction to release said headgear frame from the rotary drive frame when said levers are tilted to unhook said hook pawls from the brim.

5. A headgear frame apparatus according to claim 3, wherein said spring plungers push said brim so that said headgear frame may stop when said hook pawls ride over the outer periphery of the brim.

6. A headgear frame apparatus according to claim 4, wherein said spring plungers push said brim so that said headgear frame may stop when said hook pawls ride over the outer periphery of the brim.

7. A headgear frame apparatus according to claim 1, wherein said brim, said hook pawls, said levers, said hinges and said springs are provided transversely symmetrically at said headgear frame and s aid rotary drive frame.

* * * * *